US005816717A

United States Patent [19]

Beadman et al.

[11] Patent Number: 5,816,717

[45] Date of Patent: Oct. 6, 1998

[54] LABEL PRINTING APPARATUS WITH CHARACTER STRING MATCHING

[75] Inventors: Michael Andrew Beadman, Royston; Paul Robert Bridle, Meldreth, both of United Kingdom

[73] Assignee: Esselte N.V., St. Niklaas, Belgium

[21] Appl. No.: 797,323

[22] Filed: Feb. 10, 1997

Related U.S. Application Data

[63] Continuation of Ser. No. 570,271, Dec. 11, 1995, abandoned, which is a continuation of Ser. No. 180,244, Jan. 11, 1994, abandoned.

[30] Foreign Application Priority Data

Jan. 14, 1993 [GB] United Kingdom ..... 9300715

[51] Int. Cl.[6] ..... B41J 3/46

[52] U.S. Cl. ..... 400/83; 400/86; 400/621; 400/63; 101/288; 382/229; 395/145

[58] Field of Search ..... 400/83, 63, 70, 400/615.2, 621, 88; 271/111; 382/102, 229; 101/21, 93, 40, 288; 395/145, 800, 148; 364/401

[56] References Cited

U.S. PATENT DOCUMENTS

| | | | |
|---|---|---|---|
| 3,861,512 | 1/1975 | Coriasco et al. | 400/162.3 |
| 4,138,719 | 2/1979 | Swanstrom | 400/64 |
| 4,585,220 | 4/1986 | Zemke et al. | 270/54 |
| 4,623,418 | 11/1986 | Gombrich et al. | 156/384 |
| 4,635,136 | 1/1987 | Ciampa et al. | 358/342 |
| 4,718,784 | 1/1988 | Drisko | 400/63 |
| 4,748,439 | 5/1988 | Robinson et al. . | |
| 4,764,973 | 8/1988 | O'Hair | 382/229 |
| 4,832,513 | 5/1989 | Ikekita | 400/61 |
| 4,846,597 | 7/1989 | Bryant et al. . | |
| 4,891,088 | 1/1990 | Svyatsky | 271/111 |
| 4,934,851 | 6/1990 | Sasaki | 400/63 |
| 4,939,674 | 7/1990 | Price et al. | 101/93.4 |
| 4,947,370 | 8/1990 | Sugitani | 400/63 |
| 5,109,433 | 4/1992 | Nutenboom | 382/229 |
| 5,157,783 | 10/1992 | Anderson et al. | 395/145 |
| 5,159,667 | 10/1992 | Borrey et al. | 395/148 |
| 5,206,949 | 4/1993 | Cochran | 395/600 |
| 5,312,478 | 5/1994 | Reed et al. | 395/148 |
| 5,315,508 | 5/1994 | Bain et al. | 364/401 |
| 5,319,796 | 6/1994 | Kumagai | 400/63 |
| 5,379,057 | 1/1995 | Clough et al. | 400/70 |
| 5,393,147 | 2/1995 | Ueno et al. | 400/615.2 |
| 5,402,528 | 3/1995 | Christopher | 395/109 |
| 5,403,101 | 4/1995 | Nagase et al. | 400/621 |
| 5,467,433 | 11/1995 | Lamprecht, Jr. et al. | 395/114 |
| 5,644,657 | 7/1997 | Capps et al. | 382/229 |
| 5,742,706 | 4/1998 | Yu | 382/229 |

FOREIGN PATENT DOCUMENTS

| | | |
|---|---|---|
| 0035004 | 9/1981 | European Pat. Off. . |
| 0089190 | 9/1983 | European Pat. Off. . |
| 56-119815 | 9/1981 | Japan . |
| 61-037447 | 7/1986 | Japan . |
| 61-163470 | 7/1986 | Japan . |
| 92/09438 | 6/1992 | WIPO . |

OTHER PUBLICATIONS

Rolston, A. and Reilly, E., Editors; "Encyclopedia of Computer Science and Engineering", 2nd Ed. Published 1983 by Van Nostrand Reinhold Company, New York; pp. 819 & 820.

Microsoft Windows User's Guide, published 1988 by Microsoft Corporation, USA; pp. 4.31, 4.32.

*Primary Examiner*—Eugene H. Eickholt
*Attorney, Agent, or Firm*—Pennie & Edmonds LLP

[57] ABSTRACT

A method of recalling stored labels is disclosed in which target data is provided by a user so that only labels having label data matching the target data are displayed.

15 Claims, 5 Drawing Sheets

LABEL PRINTING APPARATUS WITH CHARACTER STRING MATCHING

This application is a continuation of application No. 08/570,271, filed Dec. 11, 1995, now abandoned, which is a continuation of application No. 08/180,244, filed Jan. 11, 1994, now abandoned.

FIELD OF THE INVENTION

The present invention relates to label printing apparatus and is particularly concerned with small, desktop label printers.

BACKGROUND OF THE INVENTION

There are now known thermal printing devices which produce labels bearing a message to be printed as defined by a user. These devices are intended particularly for the office environment and are small, desktop devices which operate with a supply of tape arranged to receive an image and a means for transferring an image onto the tape. In one known device, a tape holding case holds a supply of image receiving tape and a supply of an image transfer ribbon, the image receiving tape and the transfer ribbon being passed in overlap through a print zone of the printing device. At the print zone, a thermal printhead cooperates with a platen to transfer an image from the transfer ribbon to the tape. A printing device operating with a tape holding case of this type is described for example in EP-A-0267890 (Varitronics, Inc.). In this printing device, the image receiving tape comprises an upper layer for receiving an image which is secured to a releaseable backing layer by a layer of adhesive.

In another device, the construction of the image receiving tape is such that the upper image receiving layer is transparent and receives an image on one of its faces printed as a mirror image so that it is viewed the correct way round through the other face of the tape. In this case, a double-sided adhesive layer can be secured to the upper layer, this double-sided adhesive layer having a releaseable backing layer. This latter arrangement is described for example in EP-A-0322918 and EP-A-0322919 (Brother Kogyo Kabushiki Kaisha).

Printing devices of this type also include a display means and an input means such as a keyboard for selecting characters to be printed. Selected characters are displayed on the display means and in this way a user can compose a label to be printed. When a label has been composed a print instruction is given and the printing device proceeds to print a label. Printing devices of this type also include cutting means to cut off the printed portion of the tape to enable it to be used as a label. For use as a label, the releaseable backing layer is removed from the upper layer to enable the upper layer to be secured to a surface by means of the adhesive layer. In this way, labels having a length and character arrangement determined by a user can be made.

It is desirable in printing devices of this type to enable a user to compose a label and then to store that label for subsequent printing. This is particularly useful where a user is likely to need to produce the same label again at a later time. Rather than again compose the label, it can be recalled from a store of precomposed labels. If labels can be stored after they have been composed, there must then be a way of recalling the labels which is simple for a user to operate and which enables a particular label to be recalled quickly.

SUMMARY OF THE INVENTION

According to the present invention there is provided a label printing apparatus comprising:

input means for selecting characters for composing a label to be printed;

display means for displaying the characters selected at the input means, the input means and display means cooperating to enable a label to be composed by a user;

printing means for printing the composed label; and storage means for storing the composed label as label data defining the label, wherein a plurality of composed labels can be stored in said storage means; and recall means operable to recall said stored labels in response to target data provided by a user at the input means, the recall means being operable to provide for display only labels in said stored plurality of labels which contain label data matching said target data.

This has the advantage that when a user wants to recall a particular label, he needs only to enter a word or character string which he knows is in the label, and the label printing apparatus can identify stored labels having that word or character string to be displayed sequentially by scrolling. The user can control the scrolling by depressing a key of the input means, each depression of the key causes a next one of the generated labels to be displayed. This has a particular advantage for label printing devices where the size of the display is limited by the size of the device itself. Thus, it is not always possible for the display to display the entire label. By allowing the user to enter target data and displaying only labels including data matching that target data, it is not necessary for the target itself to be displayed since the user knows that all of the labels on the display during scrolling will include that target. He can therefore identify the label without requiring it all to be displayed.

The invention also provides a method of locating a stored label from amongst a plurality of stored labels, the method comprising:

identifying a first one of said stored labels and comparing label data defining that label with target data input by a user;

if the label data includes data matching said target data, causing said label to be displayed, or, if the label data does not include data matching said target data identifying a next one of said stored labels and comparing label data defining said next label with said target data.

For a better understanding of the present invention, and to show how the same may be carried into effect, reference will now be made, by way of example, to the accompanying drawings.

DESCRIPTION OF THE PREFERRED EMBODIMENT

Figure 1:
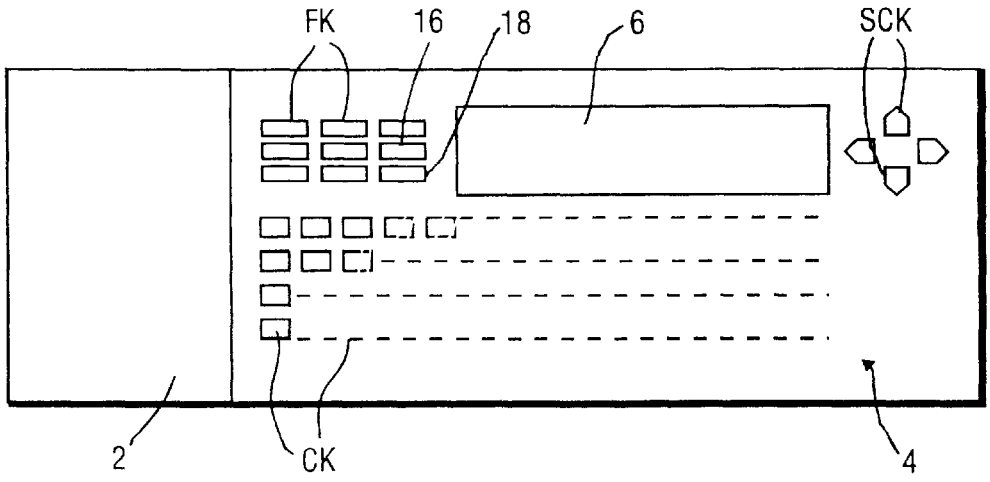
FIG. 1 is a plan view showing the front of a label printing apparatus.

FIG. 1 shows a simplified plan view of a label printing apparatus which comprises on the left-hand side a cassette receiving bay 2. The cassette receiving bay receives an image receiving tape cassette and an ink ribbon cassette, which are arranged so that the ink ribbon and image receiving tape are passed in overlap through a print zone. This particular cassette arrangement is described for example in our copending application Ser. No. 08/069,256, now U.S. Pat. No. 5,458,423, the contents of which are herein incorporated by reference. Other cassette arrangements are possible with the present invention.

The label printing apparatus also has a keyboard denoted generally by reference numeral 4. The keyboard has two parts, one part comprising function keys FK and another part comprising character keys CK. There will be a plurality of character keys to enable any desired character and/or icon to be displayed and printed but these are not all shown in FIG. 4. The keyboard also includes scroll cursor keys SCK. The label printing apparatus also has a liquid crystal graphics display 6. Among the function keys FK, reference numeral 16 denotes a save key and reference numeral 18 denotes a memory recall key.

Figure 4:
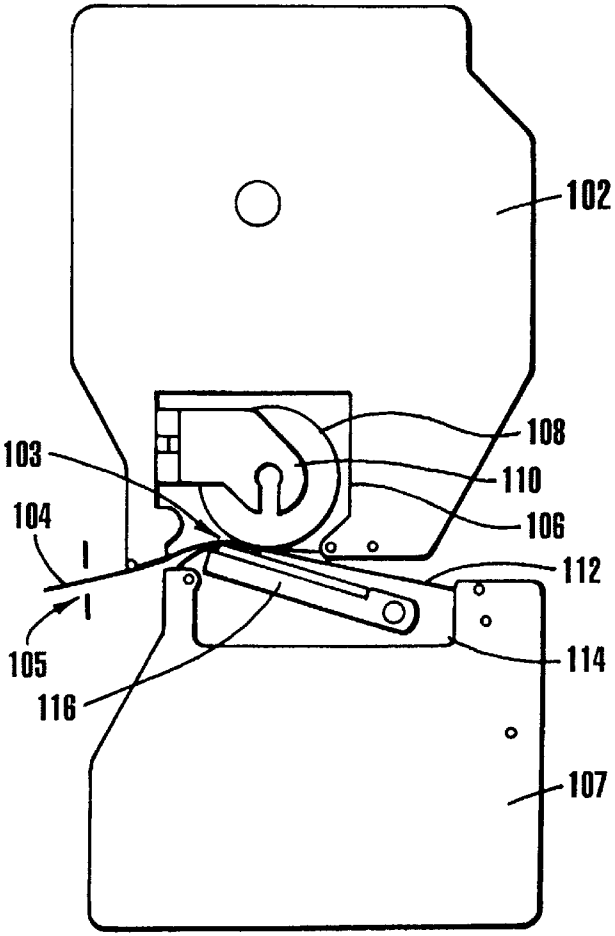
FIG. 4 is a plan view showing two cassettes inserted in a label printing apparatus.
Figure 9A:
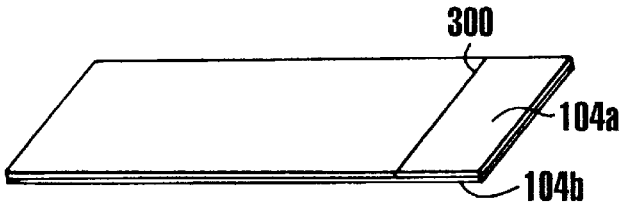
FIGS. 9*a* and 9*b* are diagrams showing labels which can be produced using the printing device.

FIG. 4 shows in plan view two cassettes arranged in the cassette receiving bay 2 of the printing apparatus. The upper cassette 102 contains a supply of image receiving tape which passes through a print zone 103 of the printer to an outlet 105 of the printer. The image receiving tape 104 comprises an upper layer 104*a* for receiving a printed image on one of its surfaces and having its other surface coated with an adhesive layer to which is secured a releasable backing layer 104*b* (see FIG. 9). The cassette 102 has a recess 106 for accommodating a platen 108 of the printer. The platen 108 is mounted for rotation within a cage moulding 110.

The lower cassette 107 contains a thermal transfer ribbon which extends from a supply spool to a take-up spool within the cassette 107. The thermal transfer ribbon 112 extends through the print zone 103 in overlap with the image receiving tape 104. The cassette 107 has a recess 114 for receiving a print head 116 of the printer. The print head 116 is movable between an operative position, shown in FIG. 4, in which it is in contact with the platen and holds the thermal transfer ribbon 112 and the image receiving tape in overlap between the print head and the platen and an inoperative position in which it is moved away from the platen to release the thermal transfer ribbon and image receiving tape. In the operative position, the platen is rotated to cause image receiving tape to be driven past the print head and the print head is controlled to print an image onto the image receiving tape by thermal transfer of ink from the ribbon 112. The print head is a conventional thermal print head having an array of pixels each of which can be thermally activated in accordance with the desired image to be printed.

Figure 5:
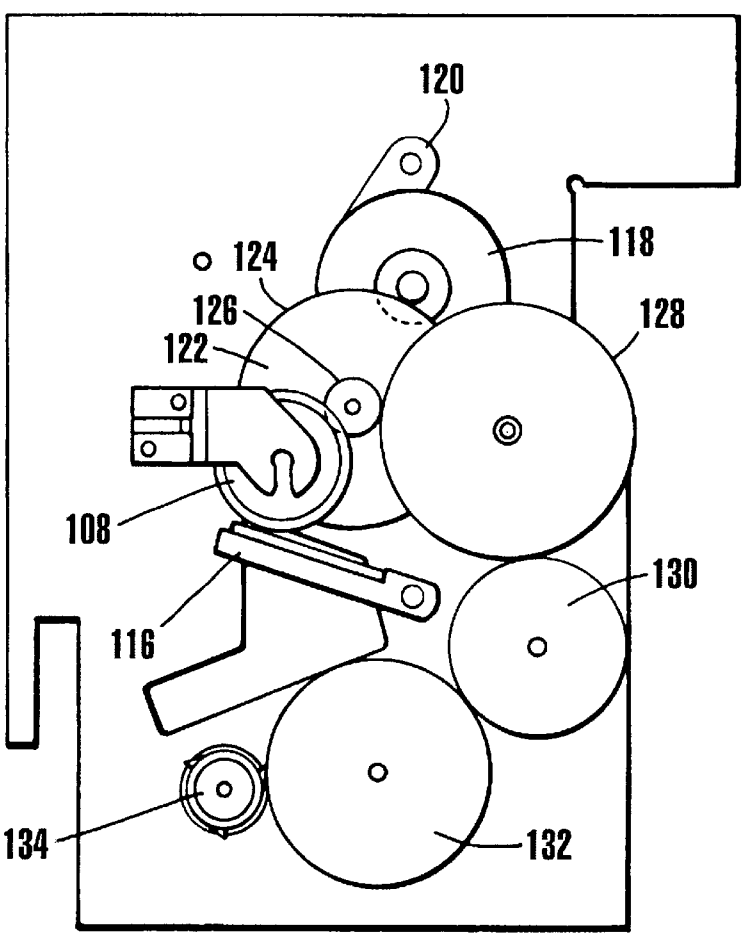
FIG. 5 is a diagrammatic plan view showing a drive train for a platen of the printing device.

FIG. 5 shows the drive train of the printing device. The printing device carries a stepper motor 118 secured to the base of the printing device by a bracket 120. The motor drives a double radius gear 122 on its larger diameter 124 while its smaller diameter 126 drives the platen 108 and a second gear wheel 128. The second gear wheel 128 drives through an intermediate gear 130 a third gear 132 which drives the take-up spool for the ink ribbon in the cassette 104. The take-up spool is designated by reference number 134 in FIG. 5.

The stepper motor 118 drives the platen 108 in steps so that for each position of the platen a line of print is printed on the image receiving tape 104. The platen 108 drives the image receiving tape through the print zone under the action of its own rotation. The rotation of the platen and the energisation of the print head 116 are controlled by a microprocessor as described in more detail hereinafter.

Figure 7:
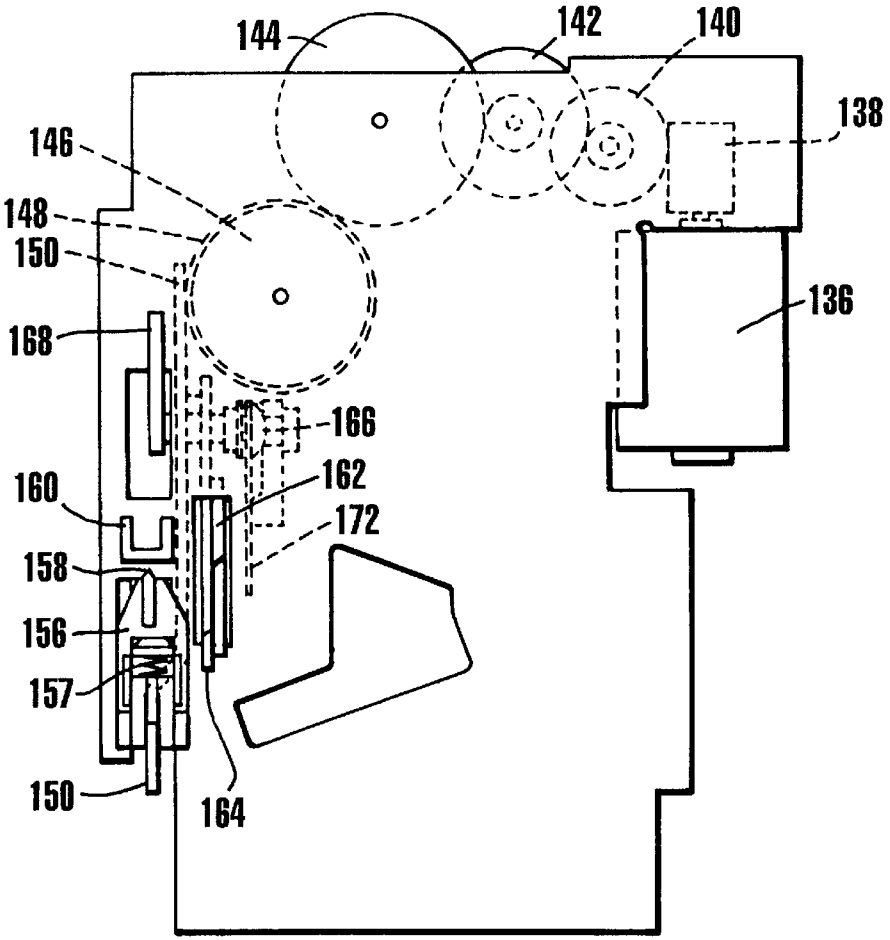
FIGS. 6 and 7 are side and plan views respectively of a cutting mechanism of the printing device.
Figure 6:
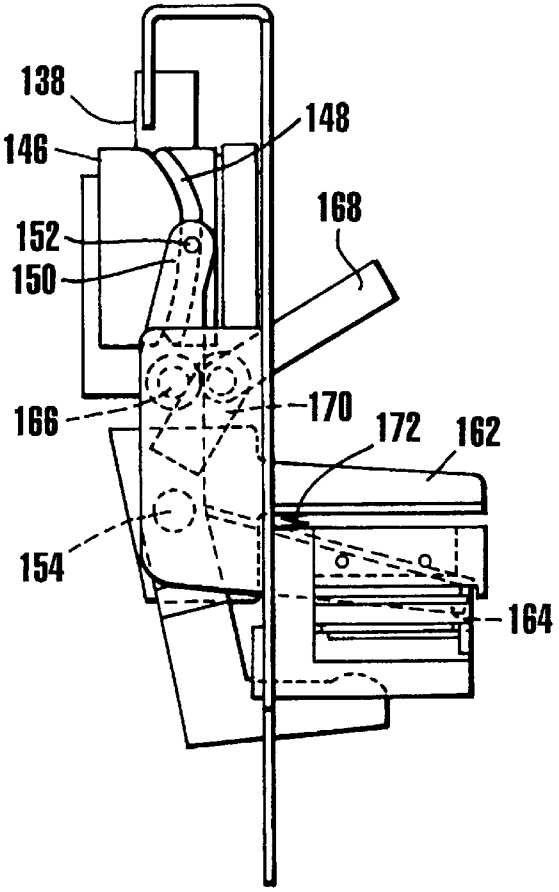

FIGS. 6 and 7 are side views and plan views respectively of a cutting mechanism of the printing device. A cutter motor 136 drives a worm gear 138. This drives a gear train comprising three gears 140, 142, 144, the last gear 144 then driving a cam 146. The cam 146 has in its surface a cam track extending circumferentially and asymmetrically. A tab cut lever arm 150 runs in the cam track 148 via a pin 152. The tab cut lever arm is pivotably mounted about a pivot point 154 and is arranged so that it can be brought into contact with a spring loaded blade holder designated generally by reference number 156 to bring a blade 158 into contact with an anvil 160. The blade holder 156 is biased by a spring 157. In an alternative arrangement, the anvil 160 could be biased instead of the blade holder 156. The blade 158 is not designed to cut entirely through the tape but is designed to cut only through the image receiving layer of the image receiving tape 104 and not through the releasable backing layer. A cut is made through all of the layers of the image receiving tape to cut off a portion of tape once printed by two cooperating blades 162, 164 operating as scissors. The blade 162 remains stationary while the blade 164 is pivoted about pivot point 154. A pin 166 secures the blade 164 to the tab cut lever arm 150 so that the blade 164 moves with the lever arm 150. In this way upward movement of the blade 164 occurs in response to movement of the tab cut lever arm 150 in the cam track 148. The pin 166 can be disengaged from the tab cut lever arm 150 by use of a disengagement lever 168. The disengagement lever causes a cam 170 to rotate, the surface of the cam 170 being such that its rotation allows the pin 166 to move out of contact with the tab cut lever arm 150 under the action of a spring 172.

Figure 9B:
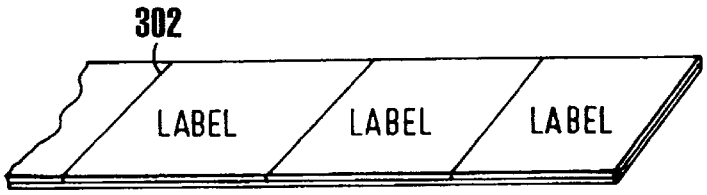

The cutting mechanism can operate in two ways. In the first mode, the pin 166 secures the blade 164 to the tab cut lever arm 150. As the cam 146 rotates, the tab cut lever arm 150 is caused to move in the track 148 into a cutting position where it brings the blade 158 into contact with the anvil 160. At the same time, the blade 164 is brought into contact with the blade 162 to perform a scissor cut. Thus, a portion of a printed tape is cut off while a tab cut 300 (see FIG. 9*a*) is made at a short distance from the main cut. In the second, "strip label" mode, the disengagement lever 168 has been rotated so that the pin 166 no longer secures the blade 164 to the tab cut lever arm 150. In these circumstances, the scissors do not operate as the cam 146 rotates but instead only a tab cut is performed at a series of locations. This provides the facility to have a continuous tape printed with a series of labels separated by individual tab cuts 300 (as shown in FIG. 9*b*).

Figure 2:
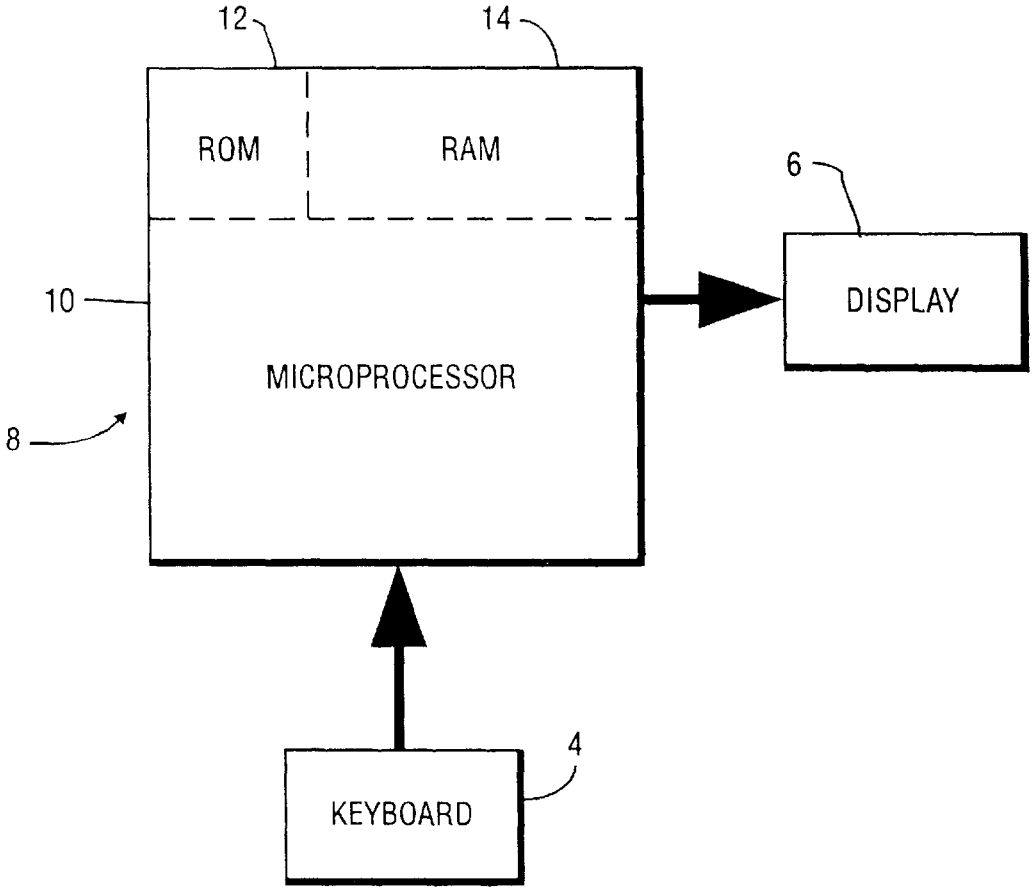
FIG. 2 is a simplified block diagram showing circuitry for controlling the storage label function.
Figure 8:
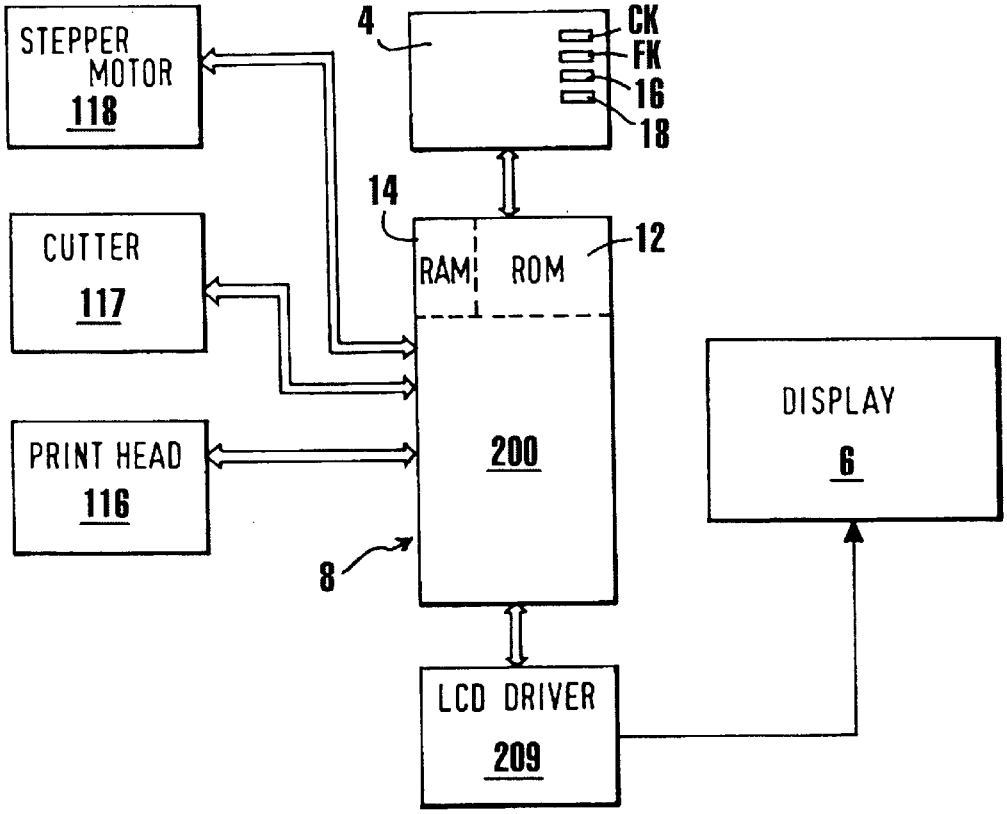
FIG. 8 is a diagrammatic sketch showing the control circuitry for the printing device.

FIG. 2 shows basic control circuitry, which includes a microprocessor 8 which includes a controller 10, read only memory 12 and random access memory 14. The controller 10 controls the display 6 in response to signals received from the keyboard 4. The circuitry for controlling the printing device is shown in more detail in FIG. 8. There is a microprocessor chip 200 having the read only memory (ROM) 12, the microprocessor 8 and random access memory capacity indicated diagrammatically by RAM 14. The microprocessor is connected to receive data input to it from a data input device such as the keyboard 4. The microprocessor chip 200 outputs data to drive the display 6 via a display driver chip 209 and also to drive the print head 116 and the stepper motor 118 for controlling the platen 108. The microprocessor chip also controls the cutting mechanism indicated diagrammatically in FIG. 8 by cutter 117 to cut the printed tape.

It will be apparent that there are many aspects of the label printing apparatus which are not described herein as they do not form part of the present invention. Reference is made to the above mentioned earlier Application for more complete details of a label printing apparatus.

As is known, the label printing apparatus allows labels to be composed and displayed on the display 6 using the character keys CK and function keys FK. Data to be printed is typed into the printing device using data input keys CK and FK on the keyboard 4. As the data is entered into the keyboard 4 it is supplied to the microprocessor 200 which drives the display 6 to display the data as it is entered. To do this, for each character which is entered, the microprocessor calls up a stored version of the character from the ROM 12. As the character is stored in compressed form this font data is stored temporarily in the RAM 14 and is manipulated by the microprocessor 8 to generate pixel data to form the character. This pixel data is transmitted in one form to the display 6 and in another form to the print head for printing. Character data is not passed to the print head for printing until a print operation is executed. Firstly, the characters for the label are entered and edited using the function keys FK in conjunction with the display 6. In accordance with the invention, when a label has been composed which is to be saved, a save button 16 on the keyboard is depressed. This causes that label to be transferred to the random access memory 14 of the controller 8 in a label storage space. It is assumed for the purposes of the following description that a plurality of labels have been composed and stored in the label storage space of the memory. Each label is stored as label data in the form of a sequence of bytes containing information defining the characters to be printed, their size and other attributes (such as bold, outline, italic etc.), their layout and other features of the label.

When a particular label is to be recalled, the user enters a target for the label, consisting of a character or plurality of characters which he knows to be present in the label. For example, he might be looking for a label with his own company name in it. The controller searches through the label storage space of the memory for all of the labels having label data matching data defining the target character(s) so that, on depression of the scroll keys SCK, only these labels are displayed sequentially during the scrolling process. Other labels stored in the memory but not containing the target will not be displayed.

It is possible to scroll through the entire memory if for some reason the search as carried out above does not reveal the particular label. Nevertheless, the search using a target is useful for cases where many labels of different types are stored in the memory and saves time in finding the label or labels required.

Figure 3:
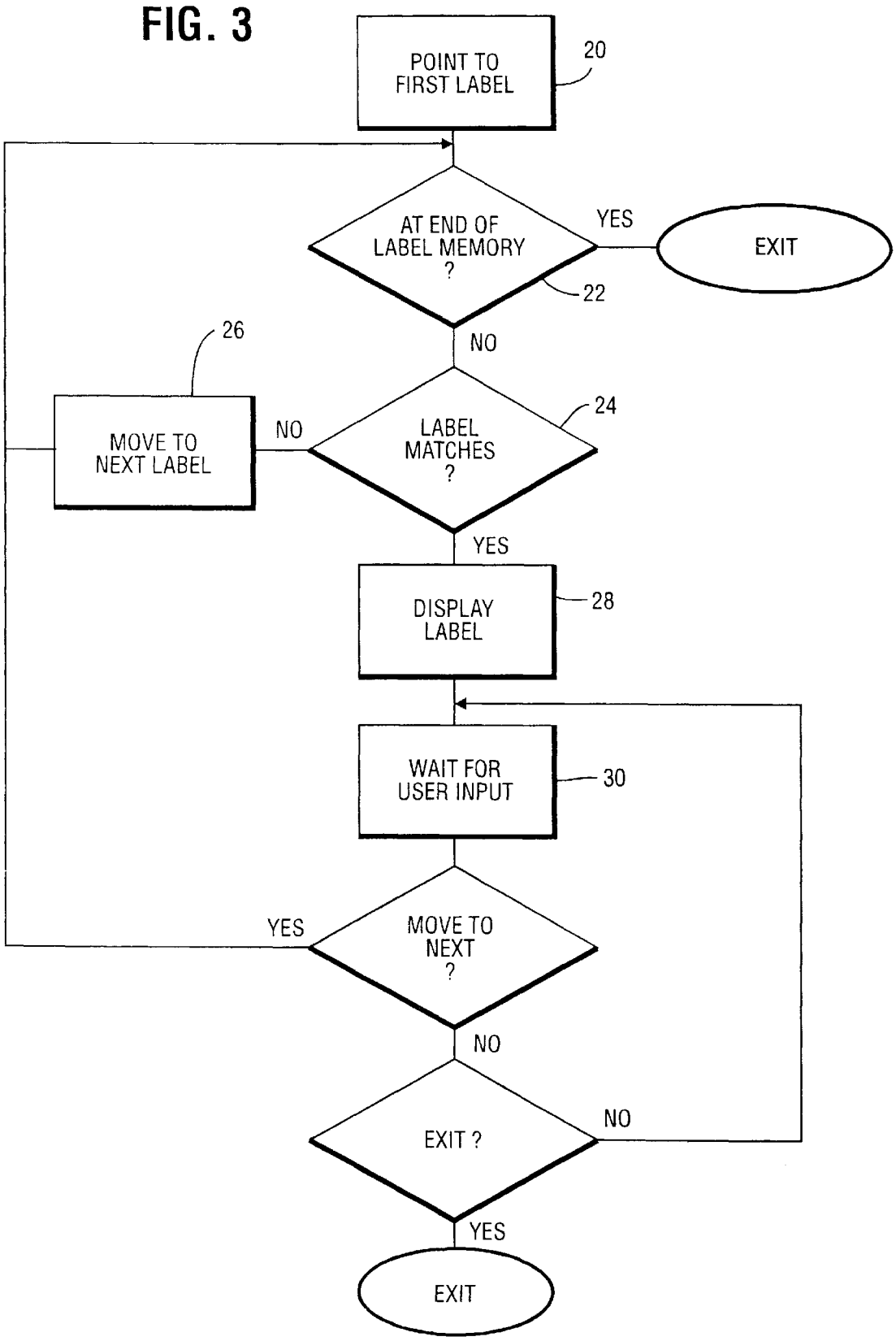
FIG. 3 is a flow chart illustrating the storage label function.

FIG. 3 illustrates how the controller operates to locate and display the labels containing the target.

When a user has input the target character(s) or word(s) and pressed the memory recall key 18, the controller points to the first label stored in its label storage space (step 20 of the flow chart in FIG. 3). In the next step it checks to see whether it has exhausted its supply of stored labels and if the answer is yes it exits from the routine as indicated by step 22. If there are labels remaining, it ascertains using a comparison whether or not the first label contains label data matching the target entered by the user as indicated at step 24. The comparison is effected by comparing the sequence of bytes constituting the target data with successive segments of the stored label data.

For example

| | | |
|---|---|---|
| target | : | "cat" |
| label text | : | "the cat sat on the mat" |
| comparisons made | : | |
| "cat" | = | "the" |
| "cat" | = | "he_" |
| "cat" | = | "e_c" |
| | . | |
| | . | |
| | . | |
| "cat" | = | "_ca" |
| "cat" | = | "cat" |

If the label does not contain the target the controller moves onto the next label as indicated by step 26.

If the label does contain the target, the label is displayed, or as much of it as can be fitted on the display (step 28). The controller then waits for user input (step 30). If the user depresses the scroll key SCK, the controller points to the next label stored in the label storage space and repeats the sequence of steps 22,24,26 or 28. When there are no labels remaining or when the user ceases to scroll by pressing an exit key, the controller exits from the routine.

Once the required label has been located by this procedure and has been displayed on the screen, the user presses a save key, for example the "return" key of the device. This causes the sequence of bytes representing the label to be copied into the RAM 14 of the microprocessor. Once this has been done the label can be edited and/or printed using the printing apparatus in the normal way.

It is possible to use the label recall function to add to an existing label which is being composed. In that event, during composition of the label a cursor key controls movement of a cursor on the display to indicate to a user his current location. If the label recall function is operated with the cursor set at a particular location, the label which is recalled will be inserted into the label being formulated. This makes it possible to insert labels into other labels without the need to reformulate a label which has already been stored.

When a label is to be printed, the microprocessor works out the pixel data for each column to be printed and also calculates the overall length of the label and the position of the print within the label.

What is claimed is:

1. A label printing apparatus for printing a label on an image receiving tape comprising:

a bay for receiving a cassette holding a supply of the image receiving tape;

input means for selecting characters for composing a label to be printed on the image receiving tape;

display means for displaying the characters selected at the input means, the input means and display means cooperating to enable a label to be composed by a user;

storage means for storing the composed label as label data defining the label, wherein a plurality of composed labels can be stored in the storage means;

recall means operable to recall the stored label in response to target data provided by a user at the input means, the recall means being operable to compare label data of each of the stored labels to the target data, and then to provide for display only labels that contain label data matching the target data, wherein the target data comprises at least some of the selected characters present in the composed label;

printing means arranged at a print zone for printing a composed label on the image receiving tape as it passes through the print zone; and cutting means for separating a printed label from the supply of image receiving tape in the cassette.

2. The label printing apparatus according to claim 1 further comprising a scroll key enabling a user to scroll through the labels provided for display by the recall means.

3. A method of locating and printing a stored label from a plurality of different stored labels, the stored labels including a plurality of characters representative of each entire label and being stored as label data, the method comprising the steps of:

attaching together an input device, a display, a printer, a memory, an electronic recaller, and a cutter to provide a self contained label printing and cutting apparatus;

retrieving from the memory the label data for each of the plurality of stored labels;

operating the electronic recaller to compare the label data of each of the plurality of stored labels with target data input through the input device by a user, said target data comprising at least some of the selected characters present in at least one of the stored labels stored as label data;

displaying on the display displayed labels including only said labels which contain label data matching said target data;

printing one of said identified stored labels on an image receiving tape with the printer; and separating the printed label from a supply of image receiving tape by cutting the tape with the cutter.

4. The method of claim 3, wherein the recaller is operated to compare the target data with all data in the label data of each of the plurality of stored labels.

5. A method of printing a label on an image receiving tape, the method comprising the steps of:

(a) selecting characters for composing a label to be printed on the image receiving tape;

(b) displaying the selected characters to enable a label to be composed by a user;

(c) storing the composed label as label data defining all characters of the label, the composed label being one of a plurality of stored composed labels;

(d) operating an electronic recaller to compare the label data of each of the plurality of stored labels with target data input by the user, the target data comprising at least some of the selected characters present in the composed label;

(e) displaying displayed labels including only those labels containing label data matching the target data;

(f) printing a composed label on the image receiving tape in a print zone, the label being printed as the image receiving tape moves through the printing zone; and (g) cutting and separating the printed label from the supply of image receiving tape;

wherein steps (a)–(g) are carried out in a self-contained label printing and cutting apparatus.

6. A label printing apparatus for printing a label on an image receiving tape comprising:

a bay for receiving a cassette holding a supply of the image receiving tape;

input means for selecting characters for composing a label to be printed on the image receiving tape;

display means for displaying the characters selected at the input means, the input means and display means cooperating to enable a label to be composed by a user;

storage means for storing the composed label as label data defining the label, wherein a plurality of composed labels can be stored in the storage means;

recall means operable to recall the stored label in response to target data provided by a user at the input means, the recall means being operable to compare label data of each of the stored labels to target data, and then to provide for display only labels that contain label data matching the target data, wherein the target data comprises at least some of the selected characters present in the composed label;

printing means arranged at a print zone for printing a composed label on the image receiving tape as it passes through the print zone; and a scroll key enabling the user to scroll through the labels provided for display by the recall means to permit one of the labels containing target data to be selected by the user.

7. A label printing apparatus for printing a label on an image receiving tape comprising:

a bay for receiving a cassette holding a supply of the image receiving tape;

input means for selecting characters for composing a label to be printed on the image receiving tape;

display means for displaying the characters selected at the input means, the input means and display means cooperating to enable a label to be composed by a user;

storage means for storing the composed label as label data defining the label, wherein a plurality of composed labels can be stored in the storage means;

recall means operable to recall the stored label in response to target data provided by a user at the input means, the recall means being operable to compare label data of each of the stored labels to the target data, and then to provide for display only labels that contain label data matching the target data, wherein the target data comprises at least some of the selected characters present in the composed label;

selecting means for selecting for printing one of the recalled stored labels;

printing means arranged at a print zone for printing the selected label on the image receiving tape as it passes through the print zone; and cutting means for separating the printed label from the supply of image receiving tape in the cassette.

8. The label printing apparatus according to claim 7 wherein the input means allows the user to modify the recalled label prior to printing.

9. In combination a label printing apparatus for printing a label on an image receiving tape and a cassette holding a supply of image receiving tape, the label printing apparatus comprising:

a bay in which the cassette is received;

input means for selecting characters for composing a label to be printed on the image receiving tape;

display means for displaying the characters selected at the input means, the input means and display means cooperating to enable a label to be composed by a user;

storage means for storing the composed label as label data, defining the label, wherein a plurality of composed labels can be stored in the storage means;

recall means operable to recall the stored label in response to target data provided by a user at the input means, the recall means being operable to compare label data of each of the stored labels to the target data, and then to provide for display only labels that contain label data matching the target data, wherein the target data comprises at least some of the selected characters present in the composed label;

printing means arranged at a fixed print zone for printing a composed label on the image receiving tape as it passes through the print zone; and cutting means for separating a printed label from the supply of image receiving tape in the cassette.

10. A self-contained label printing and cutting apparatus for printing a label on an image receiving tape comprising:

a cassette bay configured for receiving a cassette holding a supply of the image receiving tape;

an input device operable by a user for selecting characters for composing a label to be printed on the image receiving tape;

a display for displaying the characters selected at the input device, the input device and display cooperating to enable a label to be composed by a user;

a memory for storing the composed label as label data defining all characters of the label, wherein a plurality of composed labels can be stored in the memory;

an electronic recaller operable to recall the stored label in response to target data provided by a user at the input device, the recaller being operable to compare label data of each of the stored labels to the target data, then to provide for display displayed labels including only those labels that contain label data matching said target data, wherein the target data comprises at least some of the selected characters present in the composed label;

a print head arranged at a print zone for printing a recalled, composed label on the image receiving tape as it passes through the print zone; and a cutter for separating the printed label from the supply of image receiving tape in the cassette.

11. In combination, a label printing apparatus for printing a label on an image receiving tape and a cassette holding a supply of image receiving tape, the label printing apparatus comprising:

a cassette bay in which the cassette is arranged;

a keyboard for selecting characters for composing a label to be printed on the image receiving tape;

a display for displaying the characters selected at the keyboard, the keyboard and display cooperating to enable a label to be composed by a user;

a memory for storing the composed label as label data defining the label, wherein a plurality of composed labels can be stored in the memory;

recall means operable to recall the stored label in response to target data provided by a user at the keyboard, the recall means being operable to compare label data of each of the stored labels to the target data, then to provide for display only labels that contain label data matching said target data, wherein the target data comprises at least some of the selected characters present in the composed label;

a print head arranged at a print zone for printing a composed label on the image receiving tape as it passes through the print zone; and a cutter for separating the printed label from the supply of image receiving tape in the cassette.

12. The label printing apparatus of claim 11, wherein the apparatus is self-contained.

13. The label printing apparatus of claim 11, wherein the cassette bay is attached with the input device.

14. The label printing apparatus of claim 11, wherein the cutter is mounted with the printer.

15. A desktop label printing apparatus for printing an image on a receiving tape comprising:

a bay for receiving a cassette holding a supply of the image receiving tape;

input means for selecting characters for composing a label to be printed on the image receiving tape;

display means for displaying the characters selected at the input means, the input means and display means cooperating to enable a label to be composed by a user;

storage means for storing the composed label as label data defining the label, wherein a plurality of composed labels can be stored in the storage means;

recall means operable to recall the stored label in response to target data provided by a user at the input means, the recall means being operable to compare label data of each of the stored labels to the target data, and then to provide for display only labels that contain label data matching the target data, wherein the target data comprises at least some of the selected characters present in the composed label;

printing means arranged at a print zone for printing a composed label on the image receiving tape as it passes through the print zone; and cutting means for separating a printed label from the supply of image receiving tape in the cassette.

* * * * *